US007350496B2

(12) United States Patent
Nakayama et al.

(10) Patent No.: US 7,350,496 B2
(45) Date of Patent: Apr. 1, 2008

(54) INTAKE MUFFLER

(75) Inventors: Toshiaki Nakayama, Nishikamo-gun (JP); Sadahito Fukumori, Okazaki (JP); Kazuhiro Hayashi, Nishikamo-gun (JP); Naoya Katoh, Ama-gun (JP); Makoto Otsubo, Anjo (JP)

(73) Assignees: Denso Corporation (JP); Nippon Soken, Inc. (JP)

( * ) Notice: Subject to any disclaimer, the term of this patent is extended or adjusted under 35 U.S.C. 154(b) by 0 days.

(21) Appl. No.: 11/653,357

(22) Filed: Jan. 16, 2007

(65) Prior Publication Data

US 2007/0163533 A1 Jul. 19, 2007

(30) Foreign Application Priority Data

| | | |
|---|---|---|
| Jan. 13, 2006 | (JP) | 2006-005676 |
| Jan. 24, 2006 | (JP) | 2006-014883 |
| Mar. 2, 2006 | (JP) | 2006-056579 |
| Mar. 30, 2006 | (JP) | 2006-095749 |

(51) Int. Cl.
*F02M 35/10* (2006.01)

(52) U.S. Cl. ..... 123/184.57; 184/229

(58) Field of Classification Search ..... 123/184.53, 123/184.57; 181/229, 212, 214
See application file for complete search history.

(56) References Cited

U.S. PATENT DOCUMENTS 6,386,317 B1 * 5/2002 Morohoshi et al. ..... 181/229

FOREIGN PATENT DOCUMENTS

| | | |
|---|---|---|
| EP | 0 704 617 | 4/1996 |
| EP | 1 111 228 | 6/2001 |
| JP | 02 80710 | 6/1990 |
| JP | 9-264213 | 10/1997 |
| JP | 2004-293365 | 10/2004 |

* cited by examiner

*Primary Examiner*—Noah P. Kamen
(74) *Attorney, Agent, or Firm*—Nixon & Vanderhye PC

(57) ABSTRACT

A resonator is connected with an intake air pipe and forms a resonant chamber therein. The resonator includes a diaphragm, which is generally planar and is disposed between an air passage of the intake air pipe and the resonant chamber. The diaphragm forms multiple oscillation sections, which have different eigenfrequencies, respectively.

19 Claims, 10 Drawing Sheets

INTAKE MUFFLER

CROSS REFERENCE TO RELATED APPLICATION

This application is based on and incorporates herein by reference Japanese Patent Application No. 2006-005676 filed on Jan. 13, 2006, Japanese Patent Application No. 2006-014883 filed on Jan. 24, 2006, Japanese Patent Application No. 2006-056579 filed on Mar. 2, 2006, and Japanese Patent Application No. 2006-095749 filed on Mar. 30, 2006.

BACKGROUND OF THE INVENTION

1. Field of the Invention

The present invention relates to an intake muffler.

2. Description of Related Art

An intake muffler is provided to, for example, an intake air pipe (an air conductive member) of an internal combustion engine to reduce a level of a noisy sound at the intake air pipe. The intake air pipe conducts the noisy sound at multiple frequencies, which change in response to, for example, a rotational speed of the engine. In order to reduce the level of the noisy sound at the intake air pipe, a resonator is provided to the intake muffler. The resonator reduces the level of the sound at a specific frequency through use of the resonance theory of Helmholtz. As shown in FIG. 23, one previously proposed resonator 84 has a resonant chamber 83, which is communicated with an air passage 81 of an intake air pipe 80 through a communication passage 82. The resonant chamber 83 can limit a sound at a corresponding frequency, which is expressed by an equation of $K\times(S/(L\times V))^{1/2}$. Here, "K" denotes a constant, and "L" denotes a length of the communication passage 82. Furthermore, "S" denotes a cross sectional area of the communication passage 82, and "V" denotes a volume of the resonant chamber 83. When "S", "L" and "V" of the above equation are specific characteristic values, the frequency is limited to a specific value. Thus, in order to reduce the level of the noisy sound at the multiple frequencies, multiple resonators need to be provided to the intake air pipe. In general, two or three resonators are provided to the intake air pipe. However, a space of an engine room of a vehicle is limited, and thereby it is often difficult to provides the multiple resonators in the engine room. Also, each of the resonators needs to be placed at the corresponding position, which corresponds to the amplitude of the subject frequency of the sound in the intake air pipe. Thus, the number of counteractable frequencies of the noisy sound is narrowly limited.

Beside the use of the multiple resonators, another technique for reducing the level of the sound is known. According to this technique, a counteracting sound, which has the same frequency as the subject frequency of the noisy sound but has an opposite phase, is generated by forcefully vibrating a diaphragm. When the diaphragm is considered as a spring mass vibration system, a mass of a vibrating part of the diaphragm is denoted by "m", and an equivalent spring constant of the diaphragm, which is now considered as the spring, is denoted by "k". An eigenfrequency of the diaphragm can be expressed by $(k/m)^{1/2}$. Based on this, it is understandable that the equivalent spring constant "k" and/or the mass "m" of the vibrating part of the diaphragm may be changed to change the eigenfrequency of the diaphragm and thereby to counteract with the multiple frequencies. For example, Japanese Unexamined Patent Publication No. 2004-293365 discloses an apparatus that includes an actuator, which changes an eigenfrequency of a diaphragm provided to an intake air pipe. The actuator rotates a depressing bar, which is fixed to or contacts the diaphragm to change a tensile force that is applied to the diaphragm. When the tensile force is changed, the equivalent spring constant k is changed to change the eigenfrequency of the diaphragm. In this way, the multiple frequencies of the noisy sound in the intake air pipe can be attenuated with the single diaphragm and the actuator.

In Japanese Unexamined patent Publication No. 2004-293365, the actuator, which changes the eigenfrequency of the diaphragm, is received in a casing. Furthermore, a motor, the depressing bar and gears for transmitting a rotational force of the motor to the depressing bar are also arranged in the casing. In this instance, the mechanism of converting the rotational force of the motor to the eigenfrequency of the diaphragm is complicated and requires a substantial installation space. In addition, a mechanism of supplying the electric power to drive the motor is required. Thus, when the casing and the mechanism of supplying the electric power to the casing are installed in the engine room of the vehicle, the engine room is further crowded, and manufacturing costs may be increased.

In another case recited in Japanese Unexamined Patent Publication No. H09-264213, air is contained in a resonant chamber of a resonator, which is provided adjacent to a surge tank in an intake air passage that supplies intake air to an internal combustion engine. In the case where the surge tank and the resonator are placed adjacent to each other, when backfire is generated in the engine, a flame, which is generated by the backfire, may possibly be conducted into the resonant chamber through the intake air passage. When this happens, the pressure of the resonant chamber, which forms a closed space, is increased to damage the resonator. In order to limit the damage of the resonator by improving pressure resistivity of the resonator, it is considerable to increase a strength of a connection between the surge tank and the resonator or to increase a wall thickness of the resonator, which forms the resonant chamber. However, in such a case, the increase in the wall thickness of the resonator may disadvantageously cause an increase in the size of the resonator.

SUMMARY OF THE INVENTION

The present invention addresses the above disadvantages. Thus, it is an objective of the present invention to provide an intake muffler, which can effectively limit a noisy sound in an air passage of an air conductive member with a relatively simple structure without requiring a large installation space.

To achieve the objective of the present invention, there is provided an intake muffler, which includes an air conductive member and a resonator. The air conductive member forms an air passage therein to conduct intake air. The resonator is connected with the air conductive member and forms a resonant chamber therein. The resonator includes at least one diaphragm, which is generally planar and is disposed between the air passage and the resonant chamber. The at least one diaphragm forms multiple oscillation sections, which have different eigenfrequencies, respectively.

To achieve the objective of the present invention, there is also provided an intake muffler, which includes an air conductive member, a resonator and an adjuster. The air conductive member forms an air passage therein to conduct intake air. The resonator is connected with the air conductive member and forms a resonant chamber therein. The resonator includes a diaphragm, which is generally planar and is disposed between the air passage and the resonant chamber.

The diaphragm includes a magnetic material. The adjuster adjusts an eigenfrequency of the diaphragm by applying a magnetic force to the diaphragm.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

First to twelfth embodiments of the present invention will be described with reference to the accompanying drawings. In the second to twelfth embodiments, components similar to those of the first embodiment will be indicated by the same numerals and will not be described further.

First Embodiment

Figure 1:
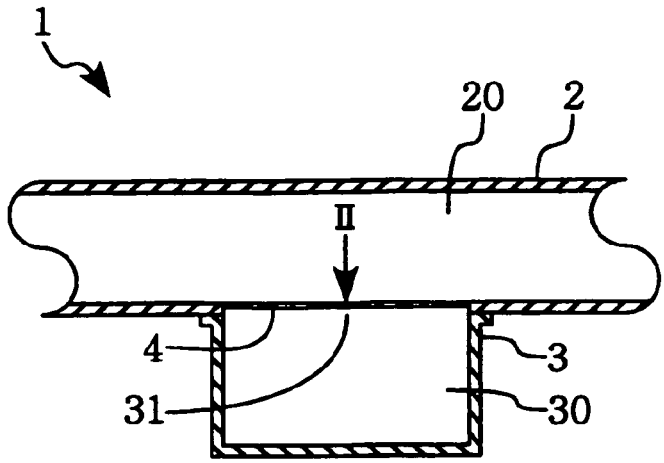
FIG. 1 is a cross sectional view of an intake muffler according to a first embodiment of the present invention.

FIG. 1 is a cross sectional view of an intake muffler 1, which reduces a level of a noisy sound, according to a first embodiment of the present invention. The intake muffler 1 includes an air conductive member 2, a resonator 3 and a diaphragm 4. The air conductive member 2 forms an air passage 20 therein, and the resonator 3 forms a resonant chamber 30 therein.

The resonator 3 is configured to protrude from a wall of the air conductive member 2, and the resonant chamber 30 of the resonator 3 is connected with the air passage 20 through an opening 31.

Figure 2:
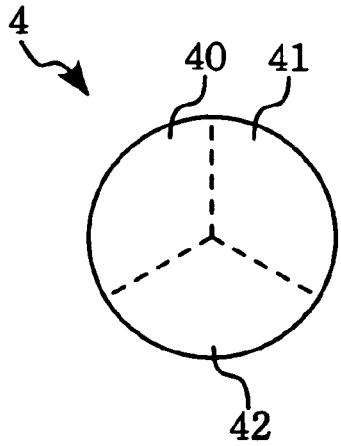
FIG. 2 is a view taken in a direction of an arrow II in FIG. 1.

The diaphragm 4 is provided at the opening 31 between the air passage 20 and the resonant chamber 30. FIG. 2 is a plan view of the diaphragm 4 that is taken in a direction of an arrow II in FIG. 1, which is perpendicular to a propagating direction of the sound in the air passage 20. As shown in FIG. 2, the diaphragm 4 has a circular shape, and the opening 31 has a corresponding circular shape, which corresponds to the circular shape of the diaphragm 4. The diaphragm 4 is formed as a thin film or plate and includes three fan-shaped oscillation sections 40-42, each of which has 120 degree angular extent. The oscillation sections 40-42 have different thicknesses, respectively. Since the thicknesses of the oscillation sections 40-42 differ from one another, the oscillation sections 40-42 have different elastic moduli and different weights (masses), respectively. Accordingly, the oscillation sections 40-42 have different eigenfrequencies, respectively. The diaphragm 4 is the thin film or plate that is made of, for example, rubber, resin (e.g., plastic wrap) or the like. In general, the air conductive member 2 is made of resin. Thus, at the time of molding the air conductive member 2, the diaphragm 4 can be simultaneously molded, thereby allowing easy formation of the diaphragm 4.

In the intake muffler 1 of the first embodiment, when the sound is propagated in the air passage 20, the diaphragm 4, which is provided in the opening 31 between the air passage 20 and the resonant chamber 30, is vibrated to limit three different eigenfrequencies.

The advantages of the intake muffler 1 will be described with reference to a case where the intake muffler 1 of the first embodiment is implemented in an intake air pipe 8 of an internal combustion engine (hereinafter, simply referred to as "engine").

Figure 3:
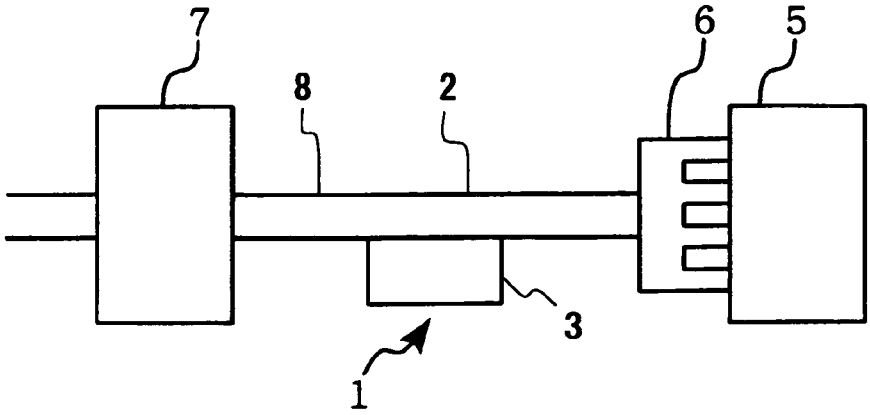
FIG. 3 is a schematic side view showing the intake muffler of the first embodiment installed to an intake air pipe of an internal combustion engine of a vehicle.

Specifically, With reference to FIG. 3, the air conductive member 2 forms the intake air pipe 8 that communicates between an air cleaner 7 and a surge tank 6, which is in turn connected to the engine 5. The air is taken through the air cleaner 7 according to the rotational speed of the engine 5. Dust and the like are removed from the intake air at the air cleaner 7. Then, the intake air passes through a throttle valve (not shown) and is supplied to the engine 5 through the surge tank 6. At this time, the sound, which has frequencies that correspond to the rotational speed of the engine 5, is generated from the engine 5 side. The intake muffler 1 of the first embodiment is placed between the air cleaner 7 and the surge tank 6 in the intake air pipe 8 of the air conductive member 2.

In the intake muffler 1 of the first embodiment, the sound, which is generated from the engine 5, is propagated in the air passage 20 of the intake air pipe 8 and vibrates the diaphragm 4, which is provided at the opening 31 of the resonant chamber 30 that is connected to the air passage 20. The frequencies of the sound, which is generated from the engine 5 and is propagated in the intake air pipe 8, can be known based on the rotational speed of the engine 5. In view of this fact, the thickness and/or the material of each of the oscillation sections 40-42 of the diaphragm 4 can be selected in such a manner that the eigenfrequency of the oscillation section 40-42 coincides with the desired one of the subject frequencies of the sound, which need to be limited.

In the intake muffler 1 of the first embodiment, by appropriately selecting the oscillation sections 40-42 of the diaphragm 4, which have the different thicknesses and/or the different materials, respectively, the multiple frequencies of the noisy sound generated from the engine 5 can be effectively limited without using a complicated mechanism. Furthermore, by simply providing the single resonator 3, which has the single diaphragm 4, in an engine room of the vehicle that has a limited space, the multiple frequencies of the sound can be effectively limited. Accordingly, the installation of the intake muffler 1 can be eased, and the manufacturing costs of the intake muffler 1 can be minimized.

Second Embodiment

Figure 4:
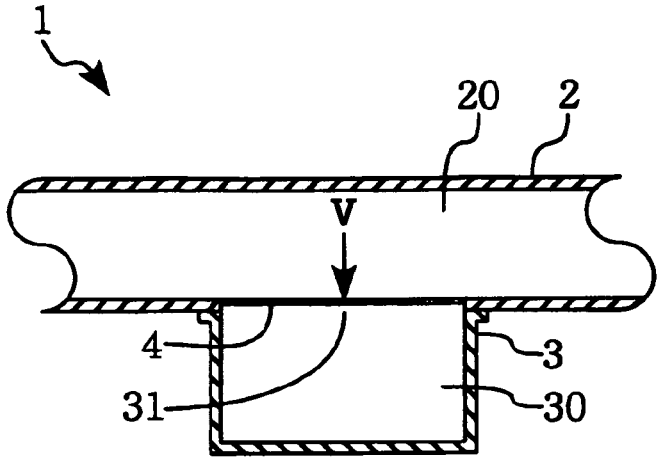
FIG. 4 is a cross sectional view of an intake muffler according to a second embodiment of the present invention.
Figure 5:
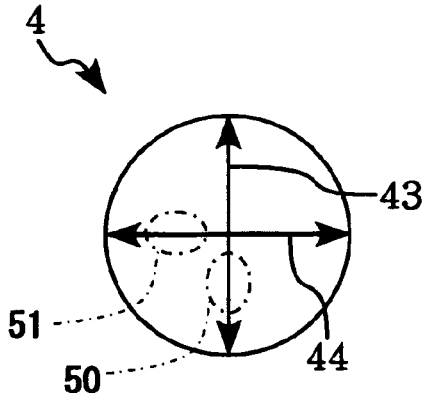
FIG. 5 is a view taken in a direction of an arrow V in FIG. 4.

The intake muffler 1 according to a second embodiment is similar to the intake muffler 1 of the first embodiment except the diaphragm 4. FIG. 4 is a cross sectional view of the intake muffler 1 of the second embodiment, and FIG. 5 is a plan view taken in a direction of an arrow V in FIG. 4.

The diaphragm 4 of the second embodiment is provided in the opening 31 and is tensioned in such a manner that a tensile force, which is exerted in the diaphragm 4 in one direction 43 in a plane of the diaphragm 4, differs from a tensile force, which is exerted in the diaphragm 4 in another direction 44 in the plane of the diaphragm 4. The above two directions 43, 44 are perpendicular to each other. More specifically, as shown in FIG. 5, the diaphragm 4 is tensioned such that the direction 43 is perpendicular to the direction 44, which coincides with the propagating direction of the sound in the air passage 20. Since the tensile force in the direction 43 differs from the tensile force in the direction 44, sections, which have different elastic moduli, respectively, are continuously formed in the diaphragm 4. In this way, the oscillation sections (e.g., oscillation sections 50, 51 of FIG. 5), which have different eigenfrequencies, respectively, are formed in the diaphragm 4.

Like in the first embodiment, the second embodiment can be implemented in the intake air pipe 8 of the engine of the vehicle.

In the intake muffler 1 of the second embodiment, the single diaphragm 4 is pulled in the two directions to exert two different tensile forces in the diaphragm 4 and thereby to implement the sections (e.g., the sections 50, 51), which have different elastic moduli, respectively. Therefore, the diaphragm 4 has the sections (e.g., the sections 50, 51), which have different eigenfrequencies, respectively, to effectively limit the noisy sound from the engine 5. Furthermore, the complicated mechanism or the electronic energy to change the eigenfrequency of the diaphragm is not required, and the intake muffler 1 of the present embodiment can be advantageously provided to the intake air pipe 8 in the engine room, which has the limited space. Thus, the costs can be minimized.

Third Embodiment

Figure 6:
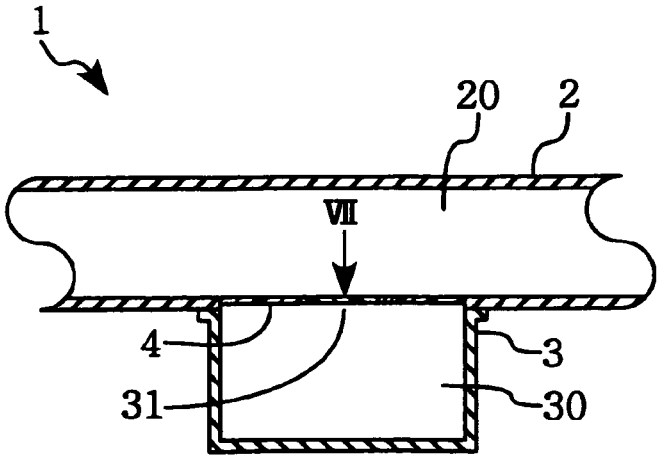
FIG. 6 is a cross sectional view of an intake muffler according to a third embodiment of the present invention.
Figure 7:
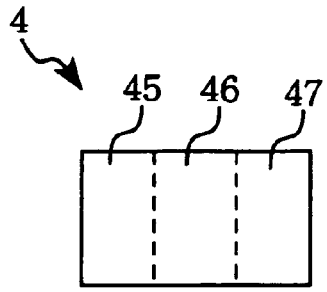
FIG. 7 is a view taken in a direction of an arrow VII in FIG. 6.

The intake muffler 1 according to a third embodiment is similar to the intake muffler 1 of the first embodiment except the opening 31 and the diaphragm 4. FIG. 6 is a cross sectional view of the intake muffler 1 of the third embodiment, and FIG. 7 is a plan view taken in a direction of an arrow VII in FIG. 6. When the opening 31 and the diaphragm 4 are seen in the direction of VII in FIG. 6, which is perpendicular to the propagating direction of the sound in the air passage 20, each of the opening 31 and the diaphragm 4 has a corresponding rectangular shape.

As shown in FIG. 7, the diaphragm 4 is a thin film or plate that includes three rectangular oscillation sections 45-47, which have different thicknesses, respectively, and are arranged one after another in the propagating direction of the sound in the air passage 20. The oscillation sections 45-47 have different elastic moduli, respectively, so that the oscillation sections 45-47 have different eigenfrequencies, respectively. Similar to the first embodiment, at the time of molding the air conductive member 2, the diaphragm 4 can be simultaneously molded, thereby allowing easy formation of the diaphragm 4. The shape of the diaphragm 4 is not limited to the rectangular shape shown in FIG. 7 and can be changed to any appropriate shape (e.g., a circular shape, an oblong shape, a polygonal shape) based on a need.

Like in the first embodiment, the third embodiment can be implemented in the intake air pipe 8 of the engine of the vehicle.

In the intake muffler 1 of the third embodiment, the single diaphragm 4 is made of the thin film or plate that includes the oscillation sections 45-47, which have different thicknesses and/or different materials to have different eigenfrequencies, respectively. Thus, the multiple frequencies of the noisy sound generated from the engine 5 can be effectively limited.

Fourth Embodiment

Figure 8:
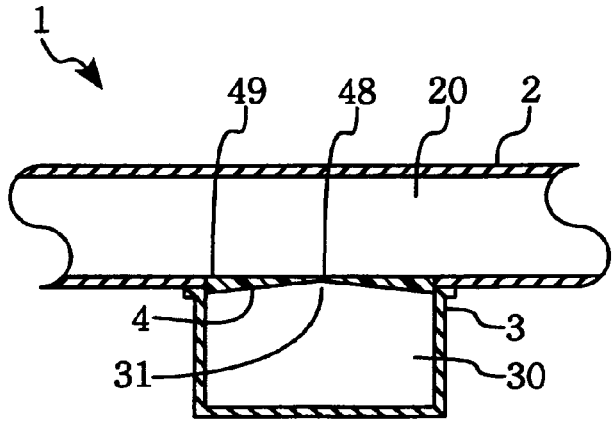
FIG. 8 is a cross sectional view of an intake muffler according to a fourth embodiment of the present invention.

The intake muffler 1 according to a fourth embodiment is similar to the intake muffler 1 of the first embodiment except the diaphragm 4. FIG. 8 is a cross sectional view of the intake muffler 1 according to the fourth embodiment.

The diaphragm 4 is the thin film or plate, which is entirely made of the same material. When the diaphragm 4 is seen in the direction perpendicular to the propagating direction of the sound in the air passage 20, the diaphragm 4 has a circular shape. A thickness of the diaphragm 4 is increased from the center of the diaphragm 4 toward the outer peripheral edge of the diaphragm 4. That is, a center section 48 of the diaphragm 4 has the smallest thickness, and an outer peripheral section 49 of the diaphragm 4 has the largest thickness. Thus, the sections, which have different elastic moduli, respectively, are formed continuously in the plane. Similar to the first embodiment, at the time of molding the air conductive member 2, the diaphragm 4 can be simultaneously molded, thereby allowing easy formation of the diaphragm 4.

Like in the first embodiment, the fourth embodiment can be implemented in the intake air pipe 8 of the engine of the vehicle.

In the intake muffler 1 of the fourth embodiment, the single diaphragm 4 has the multiple sections, which have different thicknesses to have different elastic moduli, respectively. Thus, the single diaphragm 4 has the sections that have different eigenfrequencies, respectively, to effectively limit the noisy sound generated from the engine 5. Furthermore, the complicated mechanism or the electronic energy to change the eigenfrequency of the diaphragm is not required, and the intake muffler 1 of the present embodiment can be advantageously provided to the intake air pipe 8 in the engine room, which has the limited space. Thus, the costs can be minimized.

Fifth Embodiment

Figure 9:
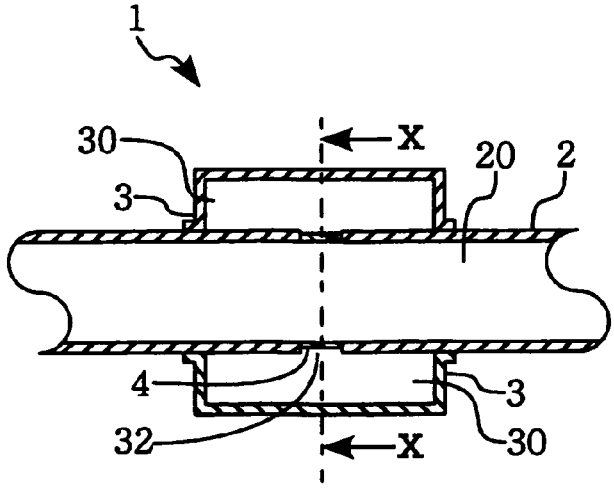
FIG. 9 is a cross sectional view of an intake muffler according to a fifth embodiment of the present invention.

FIG. 9 is a cross sectional view of the intake muffler 1 according to a fifth embodiment. In the present embodiment, the resonator 3 protrudes from the air conductive member 2 to surround the air conductive member 2. The resonant chamber 30 of the resonator 3 is communicated with the air passage 20 through an annular slit 32, which is provided in the air conductive member 2.

Figure 10:
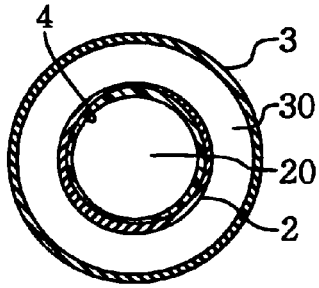
FIG. 10 is a cross sectional view taken along line X-X in FIG. 9.

The diaphragm 4 is provided to the annular slit 32 between the air passage 20 and the resonant chamber 30 and has an annular shape to surround the air passage 20. FIG. 10 is a cross sectional view along line X-X in FIG. 9. As shown in FIG. 10, the diaphragm 4 has the annular shape about the central axis of the air passage 20. A thickness of the diaphragm 4 varies in the circumferential direction of the diaphragm 4. The thickness of the diaphragm 4 continuously varies in the circumferential direction, and thereby the elastic modulus of the diaphragm 4 continuously varies in the circumferential direction. Thus, the diaphragm 4 has the sections, which have different eigenfrequencies, respectively. That is, the diaphragm 4 has the oscillation sections, which have the different eigenfrequencies, respectively.

Like in the first embodiment, the fifth embodiment can be implemented in the intake air pipe 8 of the engine of the vehicle.

In the intake muffler 1 of the fifth embodiment, the elastic modulus of the single diaphragm 4 continuously varies in the circumferential direction to have different eigenfrequencies. Thus, the intake muffler 1 can effectively limit the multiple frequencies of the noisy sound generated from the engine 5. In general, the air conductive member 2 is made of resin. Thus, at the time of molding the air conductive member 2, the diaphragm 4 can be simultaneously molded, thereby allowing easy formation of the diaphragm 4. In this way, the multiple frequencies of the noisy sound can be limited without a need for providing multiple resonators to the intake air pipe 8. Furthermore, the diaphragm can be easily installed to the intake air pile 8, so that manufacturing costs can be minimized.

Sixth Embodiment

The intake muffler 1 according to a sixth embodiment is similar to the intake muffler 1 of the second embodiment except a location of the diaphragm 4. Thus, in the following description, components, which are similar to those of the second embodiment, will be indicated by the same numerals and will not be described further.

Figure 11:
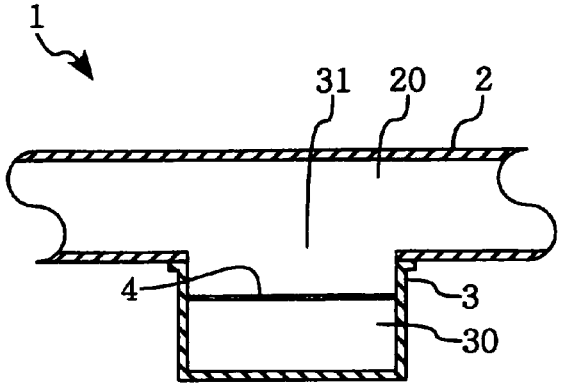
FIG. 11 is a cross sectional view of an intake muffler according to a sixth embodiment of the present invention.

FIG. 11 is a cross sectional view of the intake muffler 1 according to the sixth embodiment.

The diaphragm 4 is placed in a corresponding position, which is spaced radially outward from the opening 31, in the interior space of the resonator 3 such that the diaphragm 4 divides between the air passage 20 and the resonant chamber 30. Thus, at the time of assembly, the diaphragm 4 may be preinstalled in the interior space of the resonator 3, and then the resonator 3, which has the preinstalled diaphragm 4, may be connected to the air conductive member 2 by, for example, welding or bonding. In order to limit the multiple frequencies of the noisy sound, the tensile force, which is exerted in the diaphragm 4 in the one direction, is changed from the tensile force, which is exerted in the diaphragm 4 in the other direction. In this way, the elastic modulus of the diaphragm 4 continuously varies to provide the sections, which have the different elastic moduli, respectively, in the diaphragm 4. According to the sixth embodiment, the diaphragm 4, which effectively limits the multiple frequencies of the noisy sound, can be easily installed.

Like in the second embodiment, the sixth embodiment can be implemented in the intake air pipe 8 of the engine of the vehicle.

Seventh Embodiment

Figure 12:
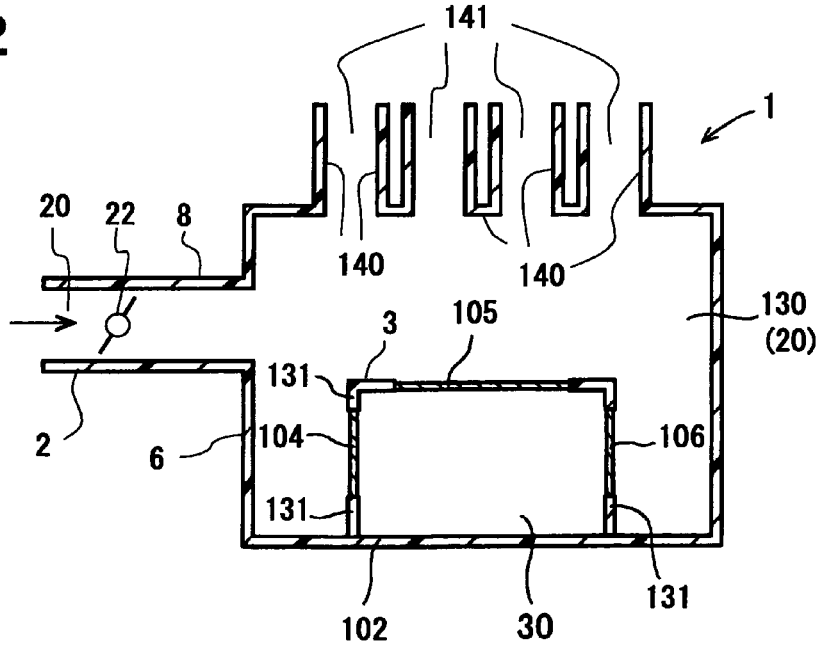
FIG. 12 is a cross sectional view of an intake muffler according to a seventh embodiment of the present invention.

As shown in FIG. 12, the air conductive member 2 of the intake muffler 1 according to a seventh embodiment forms the surge tank 6, which is provided on a downstream side of a throttle valve 22 to communicate between the throttle vale 22 and communication passages 141 of the intake manifold 140. The surge tank 6 forms a tank chamber 130 therein as a part of the air passage 20. The resonator 3 is placed in the tank chamber 130.

The surge tank 6 is a component, which is provided in the passage between the throttle valve 22 and the intake manifold 140 at the location adjacent to the communication passages 141 of the intake manifold 140 to reserve the air (or the mixed air) therein. Specifically, the surge tank 6 is the air reservoir, which is provided in the intake air system of the engine to limit intake air pulsations and intake air interferences, which would deteriorates a sensing accuracy of an air flow meter. Furthermore, the surge tank 6 temporarily reserves the air to increase the air density and thereby to increase the flow speed of the air, thereby resulting in an improvement in the intake efficiency of the air.

The resonator 3 has partition walls 131, which define the resonant chamber (closed chamber) 30 in cooperation with a wall 102 of the surge tank 6. Multiple diaphragms 104-106 are installed to the partition walls 131 of the resonator 3.

The partition walls 131 are the components, which define the resonant chamber 30 of the resonator 3 and are formed integrally with the surge tank 6. In the present embodiment, the partition walls 131 are arranged to have a generally box shape, one surface of which is defined by the wall 102 of the surge tank 6. In the present embodiment, the surge tank 6 and the resonator 3 are formed integrally. Alternatively, the surge tank 6 and the resonator 3 may be formed separately.

The material of the walls 102 of the surge tank 6 and the material of the partition walls 131 of the resonator 3 are not limited to any particular one as long as a required rigidity, which is required for the intake muffler, can be achieved. In the present embodiment, the walls 102, 131 are made of nylon resin.

The diaphragms 104-106 are embedded in the partition walls 131 and divide between the resonant chamber 30 of the resonator 3 and the tank chamber 130 of the surge tank 6. The diaphragms 104-106 resonate with the vibrations of the air in the surge tank 6 to damp the vibrations by the action of the dynamic damper.

In general, a diaphragm may be considered as a spring mass vibration system. Specifically, a mass of a vibrating part of the diaphragm is denoted by "m". The diaphragm and the resonant chamber of the resonator are regarded as a spring, and an equivalent spring constant of this spring is denoted by "k". Furthermore, a surface area of the vibrating part of the diaphragm is denoted by "S". A displacement of the diaphragm (a displacement of a portion at which the diaphragm is converted into a material particle) is denoted by "x". A sound pressure change in the surge tank is denoted by "$P_0$". In such a case, an equation of motion of the diaphragm can be expressed by the following equation. At this time, an eigenfrequency of the diaphragm can be expressed by $(k/m)^{1/2}$. Accordingly, it is understood that when the eigenfrequency of the diaphragm needs to be changed, the equivalent spring constant "k" and/or the mass "m" of the vibrating portion of the diaphragm may be changed.

$$m\frac{d^2}{dt^2}x + kx = SP_0$$

In the present embodiment, the surface of each partition wall 131 of the resonator 3 is provided with its corresponding diaphragm 104-106. That is, in the intake muffler 1 of the present embodiment, five diaphragms (only three of the diaphragms are shown in FIG. 12) 104-106 are provided. The diaphragms 104-106 are formed to have different eigenfrequencies, respectively. As discussed above, the eigenfrequency of each diaphragm 104-106 can be adjusted by changing the equivalent spring constant "k" and/or the mass "m" of the vibrating portion of the diaphragm 104-106. In the present embodiment, the tensile force, which is applied to the diaphragm 104-106, is changed to adjust the eigenfrequency of each diaphragm 104-106.

A material of each diaphragm 104-106 is not limited to any particular one as long as it can resonate with the vibration of the air to function as the resonator. In the present embodiment, a film or plate made of nylon resin is used to form each diaphragm 104-106. In order to have the diaphragms 104-106, which have the different eigenfrequencies, respectively, the diaphragms 104-106 may have different wall thicknesses and/or may be made of different materials, respectively, besides having the different tensile forces applied to the diaphragms 104-106.

In the intake muffler 1 of the present embodiment, the resonator 3 is provided in the tank chamber 130 of the surge tank 6. In this way, while the functions of the surge tank 6 are implemented, the resonator 3 in the surge tank 6 can effectively reduce the noisy sound in the intake air system. Furthermore, the resonator 3 has the five diaphragms to damp the five different eigenfrequencies, so that the resonator 3 can damp the wide range of the noisy sound.

Furthermore, in the intake muffler 1 of the present embodiment, since the resonator 3 is provided in the surge tank 6, an increase in the size of the intake muffler 1 can be advantageously limited in comparison to a case where the resonator 3 is newly provided outside of the surge tank 6. Thus, according to the present embodiment, there is provided the relatively compact intake muffler, which can limit the intake air pulsations, the intake air interferences and the noisy sound.

Eighth Embodiment

Figure 13:
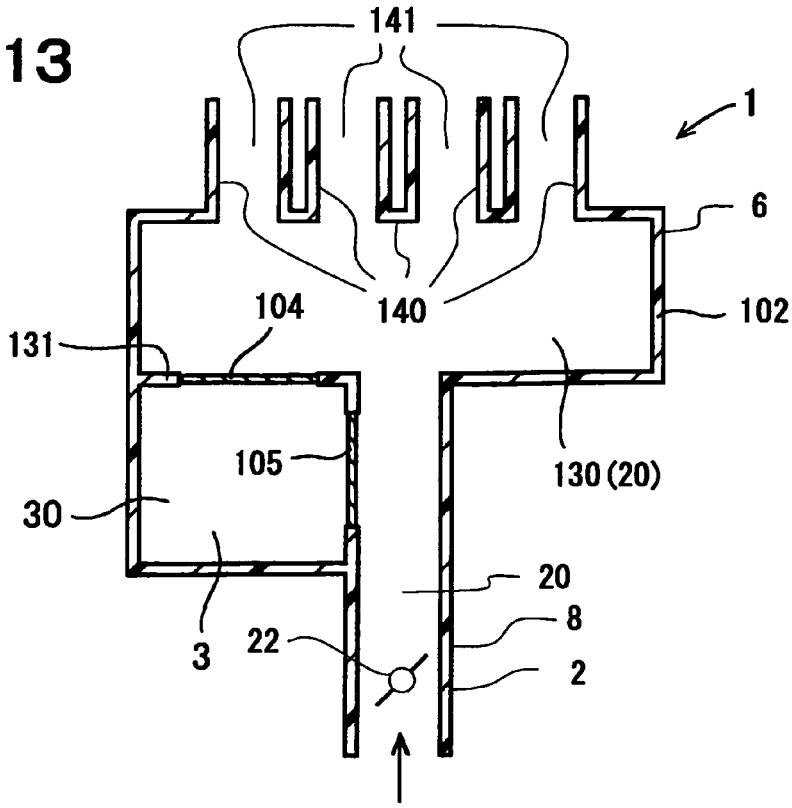
FIG. 13 is a cross sectional view of an intake muffler according to an eighth embodiment of the present invention.

The intake muffler 1 according to an eighth embodiment is similar to the intake muffler 1 of the seventh embodiment except that two partition walls of the resonator 3 are made of the walls 102 of the surge tank 6. FIG. 13 shows the intake muffler 1 of the eighth embodiment.

In the intake muffler 1 of the present embodiment, the partition wall 131 defines a portion of the air passage 20, and the number of the diaphragms 104-105 differs from that of the seventh embodiment. Other than these points, the structure of the intake muffler 1 of the present embodiment is similar to that of the seventh embodiment. Thus, in the present embodiment, advantages similar to those of the seventh embodiment can be achieved.

Ninth Embodiment

Figure 14:
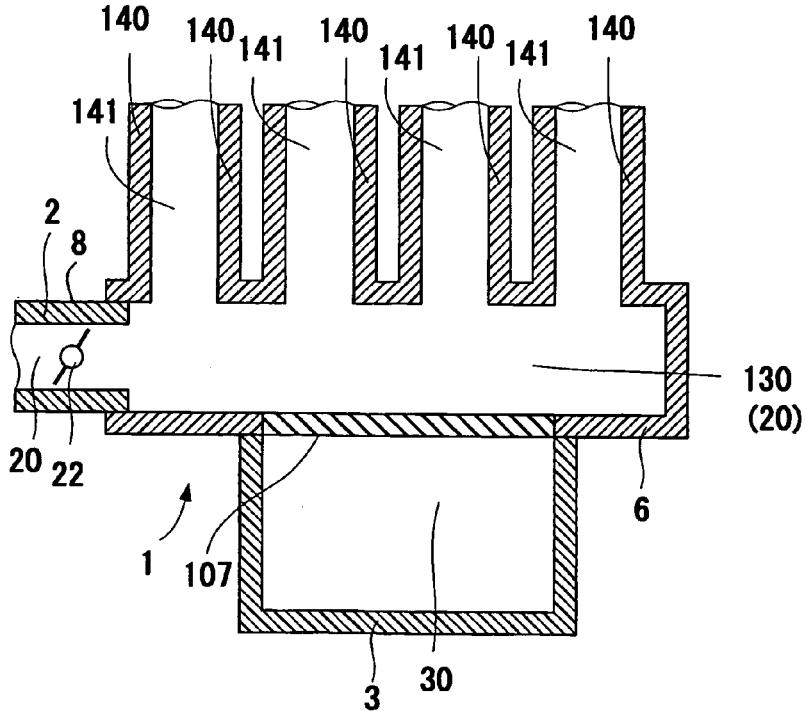
FIG. 14 is a cross sectional view of an intake muffler according to a ninth embodiment of the present invention.

FIG. 14 shows the intake muffler 1 according to a ninth embodiment. In the present embodiment, the surge tank 6 and the intake manifold 140 are formed integrally from resin. Furthermore, the intake air pipe 8 of the air conductive member 2, which receives the throttle valve 22, is formed separately from the surge tank 6 and is thereafter joined to the surge tank 6 by, for example, welding or bonding. Alternatively, similar to the seventh and eighth embodiments, the intake air pipe 8 of the air conductive member 2, which receives the throttle valve 22, may be formed integrally with the surge tank 6 from the resin.

The resonator 3 has the resonant chamber 30, which extends from the tank chamber 130. In the present embodiment, the resonant chamber 30 extends radially outward from the tank chamber 130, i.e. extends downward in FIG. 14. The resonant chamber 30 is defined by the walls of the resonator 3 and a diaphragm 107 and is air-tightly closed by the diaphragm 107. Nonflammable gas is filled in the closed resonant chamber 30 of the resonator 3. The filled nonflammable gas may be, for example, $CO_2$, $N_2$ or Ar.

The resonator 3 is made of resin. In the present embodiment, the resonator 3 is made separately from the surge tank 6 and the intake manifold 140. The resonator 3 may be joined to the surge tank 6 by, for example, ultrasonic welding. In this way, the surge tank 6, the intake manifold 140 and the resonator 3 are integrally assembled.

In the present embodiment, the diaphragm 107 is made of natural rubber (or alternatively synthetic rubber or resin). The diaphragm 107 is fixed to the surge tank 6 and the resonator 3 by, for example, welding. The diaphragm 107 divides between the tank chamber 130 of the surge tank 6 and the resonant chamber 30 of the resonator 3. In this way, the space, which is surrounded by the walls of the resonator 3 and the diaphragm 107, forms the resonant chamber 30. That is, the tank chamber 130 side end of the resonant chamber 30 is air-tightly closed by the diaphragm 107. In one instance, the diaphragm 107 may have multiple oscillation sections, which have different eigenfrequencies, respectively, by constructing the diaphragm 107 in a manner similar to one of the diaphragms 4 of the first to fourth embodiments.

As discussed above, the tank chamber 130 and the resonant camber 30 are separated from one another by the diaphragm 107. Thus, the air will not penetrate from the tank chamber 130 into the resonant chamber 30. Therefore, during the low speed operation of the engine, the intake air of the tank chamber 130 will not flow into the resonant chamber 30. Therefore, at the time of operating the engine, particularly, at the time of operating the engine at the low rotational speed, the response of the engine can be improved.

The diaphragm 107 is vibrated by the pressure change of the intake air that flows in the intake air pipe 8, the tank chamber 130 and the communication passages 141. At this time, the diaphragm 107 resonates with the intake air sound, which is generated by the pressure pulsation of the intake air, to effectively limit the noisy sound like in the case of the above embodiments.

In the ninth embodiment, the diaphragm 107 divides between the resonant chamber 30 and the tank chamber 130. Thus, when the backfire is generated in the engine, the flame will be cut by the diaphragm 107 and will not be conducted to the resonant chamber 30. Thus, the increase in the pressure in the resonant chamber 30 is effectively limited. As a result, it is not required to increase the wall thickness of the resonator 3 to increase the pressure resistivity of the resonator 3, so that the size of the resonator 3 and of the entire intake muffler 1 can be made compact.

In the ninth embodiment, the nonflammable gas is filled in the resonant chamber 30. Thus, even when the diaphragm 107 is damaged to communicate between the tank chamber 130 and the resonant chamber 30, the conduction of the flame is effectively limited by the nonflammable gas filled in the resonant chamber 30. Therefore, the pressure increase in the resonant chamber 30 is limited, and the further conduction of the flame is limited. As a result, without increasing the mechanical strength of the resonator 3, the damage is effectively limited, and the safety of the intake muffler 1 is increased. Here, it should be noted that if the limitation of the conduction of the flame is the main importance, the thickness of the diaphragm 107 may be made uniform throughout the diaphragm 107 to implement the single oscillation section, which has the single eigenfrequency, instead of providing the multiple oscillation sections, which have different eigenfrequencies, respectively.

Also, according to the ninth embodiment, even when the surge tank 6, which forms the tank chamber 130, is placed adjacent to the resonator 3, which forms the resonant chamber 30, the conduction of the flame is effectively limited by the diaphragm 107 at the time of occurrence of the backfire. As a result, at the time of determining the positions of the surge tank 6 and of the resonator 3, the influences of the backfire need not be considered. Thus, a design freedom of the intake muffler 1 can be improved.

The ninth embodiment may be modified as follows. In the following modifications, only the differences with respect to the ninth embodiment will be described for the sake of simplicity. Also, as discussed in the ninth embodiment, it should be noted that each of the following diaphragms may have the multiple oscillation sections, which have the different eigenfrequencies, like in the first to fourth embodiment or may have the single oscillation section, which has the single eigenfrequency.

Figure 15:
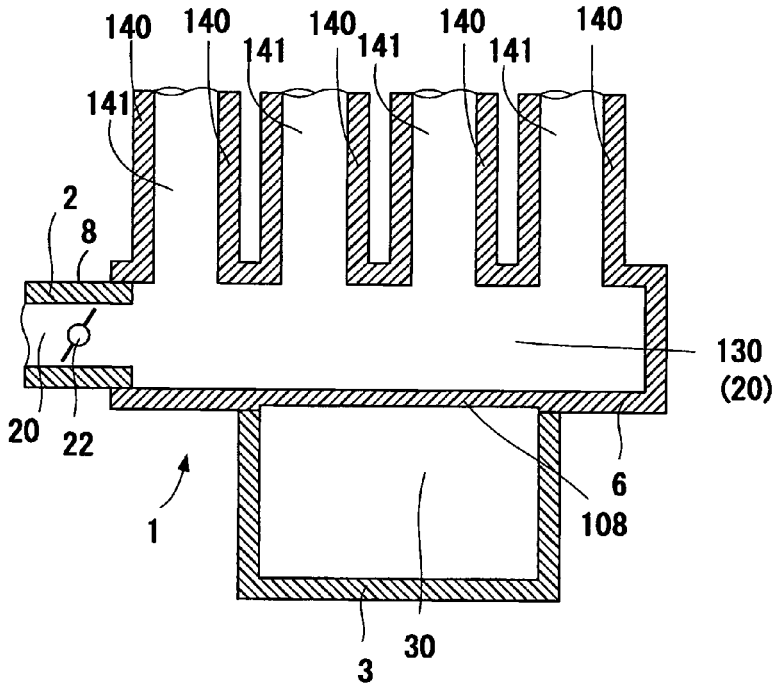
FIG. 15 is a cross sectional view of a first modification of the ninth embodiment.

FIG. 15 shows a first modification of the ninth embodiment. In the first modification, the surge tank 6 has a thin walled diaphragm 108 at the area adjacent to the resonator 3. The diaphragm 108 is formed by reducing the thickness of the corresponding portion of the wall of the surge tank 6. Specifically, the diaphragm 108 has the thickness, which is smaller than that of the rest of the surge tank 6. In this way, the diaphragm 108 forms the oscillation section(s), which is vibrated upon the pressure change of the intake air.

According to the first modification, the surge tank 6 has the diaphragm 108, which is relatively thin. Thus, the diaphragm 108 can be formed integrally with the surge tank to reduce the number of the components and to simplify the structure.

Figure 16:
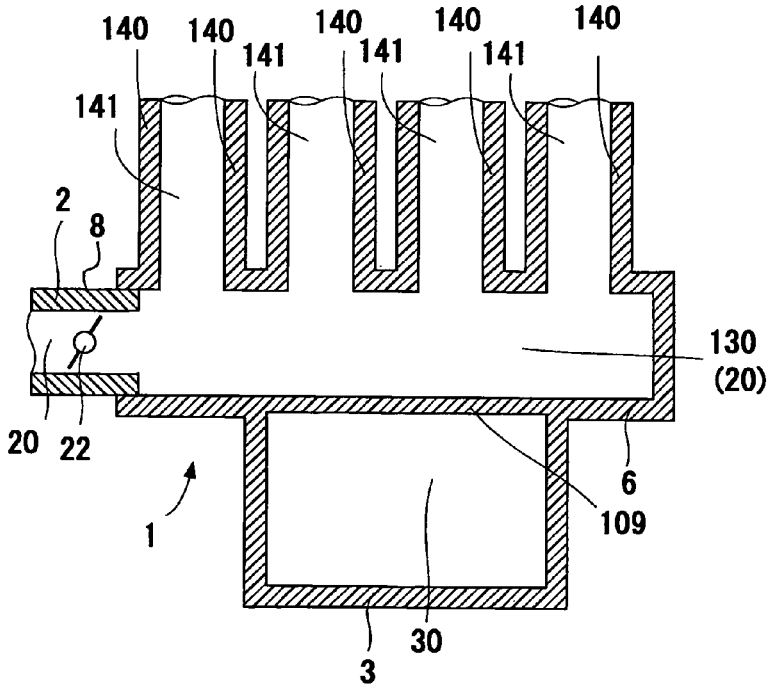
FIG. 16 is a cross sectional view of a second modification of the ninth embodiment.

FIG. 16 shows a second modification of the ninth embodiment. In the second modification, the surge tank 6, the intake manifold 140, the resonator 3 and a diaphragm 109 are integrally formed. In this way, the number of the components can be further reduced, and the structure can be further simplified.

Figure 17:
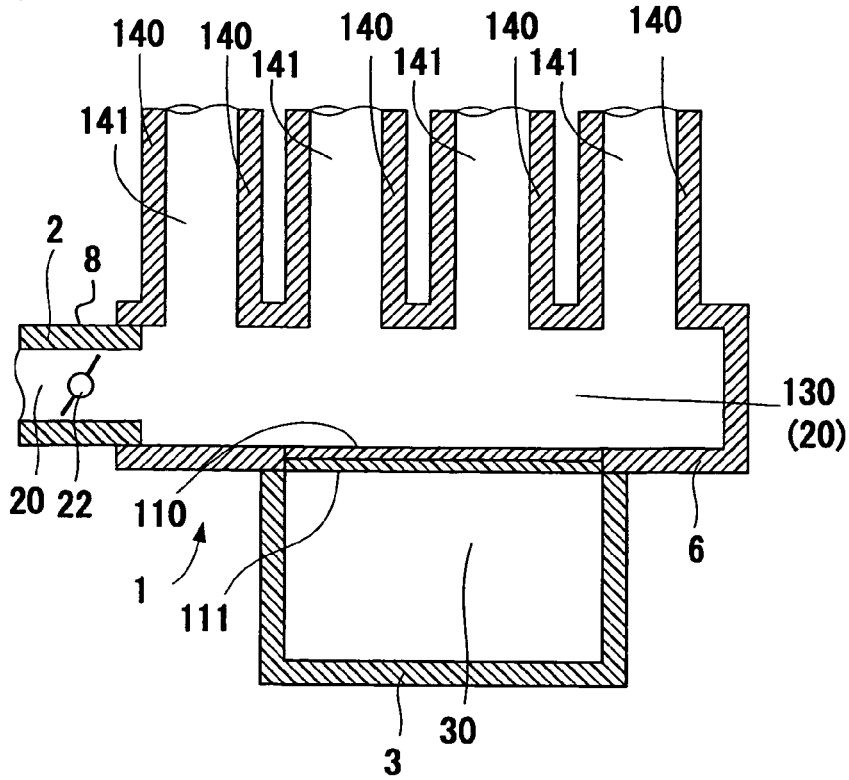
FIG. 17 is a cross sectional view of a third modification of the ninth embodiment.

FIG. 17 shows a third modification of the ninth embodiment. In the third modification, multiple diaphragms 110, 111 are provided. In the present modification, the two diaphragms 110, 111, which are made of different resin materials, respectively, are stacked one after another. The diaphragms 110, 111 are made of the different resin materials, respectively, to have different eigenfrequencies, respectively.

The diaphragms 110, 111 may be made of the same material. In such a case, the thickness of the diaphragm 110 may be changed from the thickness of the diaphragm 111. Even in this way, the diaphragms 110, 111 can have the different eigenfrequencies to damp the different frequencies of the noisy sound.

Furthermore, the number of the diaphragms is not limited to two and may be three or more.

Figure 18:
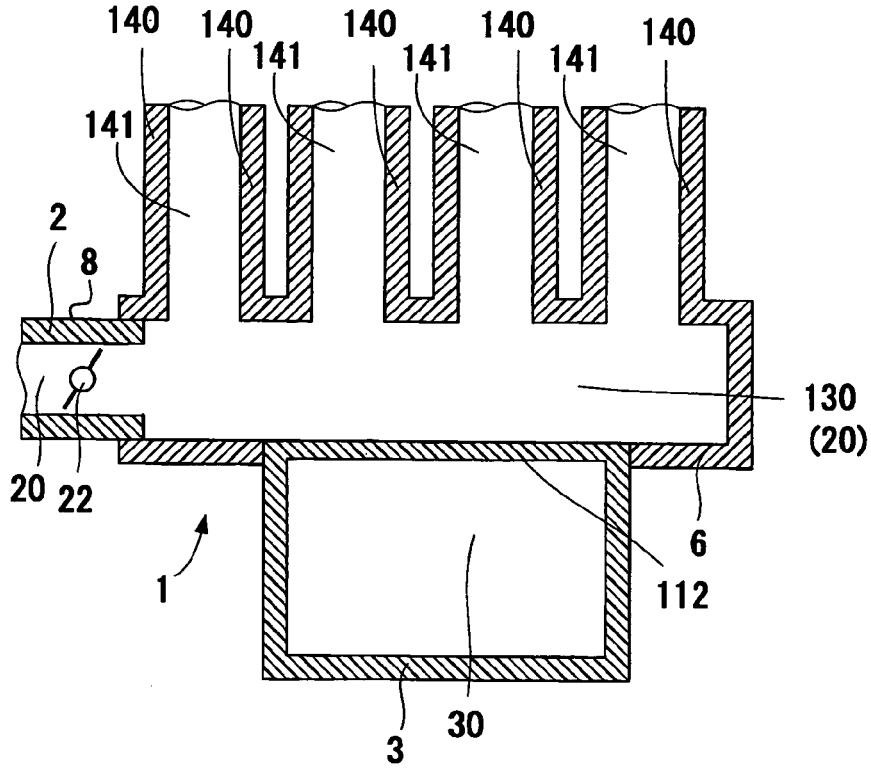
FIG. 18 is a cross sectional view of a fourth modification of the ninth embodiment.

In the first modification, the surge tank 6, which has the diaphragm 108, and the resonator 3 are integrally assembled together. Alternatively, as in a fourth modification shown in FIG. 18, the resonator 3 may have a diaphragm 112, which is formed as a part of the wall of the resonator 3, and this resonator 3 and the surge tank 6 may be integrally assembled together.

In the above-described ninth embodiment and its modifications, the surge tank 6, the intake manifold 140 and the resonator 3 are made of the resin. Alternatively, the surge tank 6, the intake manifold 140 and the resonator 3 may be made of metal.

Furthermore, in the ninth embodiment, the diaphragm 107 is made of the natural rubber. Alternatively, the material of the diaphragm 107 may be changed to any other suitable rubber, such as acrylonitrile butadiene rubber (NBR). Furthermore, the material of the diaphragm 107 is not limited to the rubber and may be any suitable resin, such as acrylic resin or polyamide resin. Furthermore, the material of the diaphragm 107 may be metal, such as aluminum. Although the resonance frequency range of the metal is relatively narrow, the thickness of the diaphragm 107 may be adjusted in an appropriate manner to damp the wide variety of frequencies.

Tenth Embodiment

Figure 19:
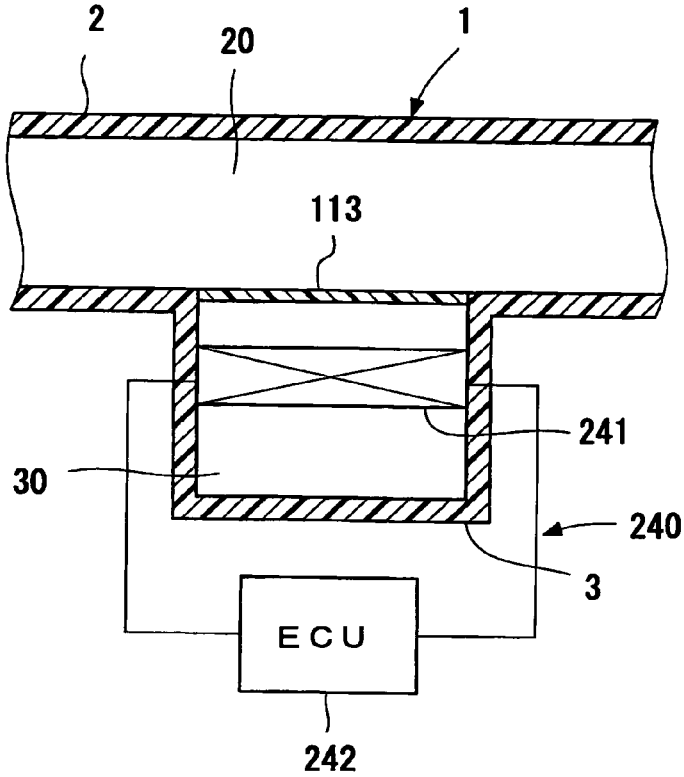
FIG. 19 is a cross sectional view of an intake muffler according to a tenth embodiment of the present invention.

FIG. 19 shows the intake muffler 1 according to a tenth embodiment. The intake muffler 1 of the tenth embodiment is similar to that of the first embodiment except the following points. Specifically, a diaphragm 113 of the tenth embodiment is made of a single material and has a generally uniform thickness throughout the diaphragm 113, so that the diaphragm 113 has the single oscillation section, which has the single eigenfrequency. Furthermore, the material of the diaphragm 113 is the resin or the rubber, which contains a magnetic material. For instance, the diaphragm 113 may be molded from the resin or the rubber, into which the magnetic material is kneaded. Furthermore, the intake muffler 1 includes an adjuster 240, which adjusts an eigenfrequency of the diaphragm 113.

The adjuster 240 includes an electromagnetic circuit 241 and an ECU (a controller) 242. The electromagnetic circuit 241 has an electromagnet, which includes, for example, a coil and an iron core. The ECU 242 controls the entire engine system including the intake muffler 1. The ECU 242 includes a microcomputer, which has, for example, a CPU, a RAM and a ROM. The ECU 242 senses a rotational speed of the engine through a rotational speed sensor (not shown). The ECU 242 controls the electric power, which is supplied to the electromagnetic circuit 241, based on the sensed rotational speed of the engine (engine operational information). Therefore, a magnetic force of the electromagnetic circuit 241, which attracts the diaphragm 113, changes according to the rotational speed of the engine.

In the present embodiment, the electromagnetic circuit 241 is received in the resonant chamber 30 of the resonator 3. When the electromagnetic circuit 241 is received in the resonant chamber 30 of the resonator 3, the electromagnetic circuit 241 is placed on the opposite side of the diaphragm 113, which is opposite from the air passage 20. The position of the electromagnetic circuit 21 is not limited to the resonant chamber 30 of the resonator 3. Specifically, as long as the electromagnetic circuit 241 can apply the magnetic force to the diaphragm 113, it is possible to place the electromagnetic circuit 241 in any other appropriate location, such as in the air passage 20 or at the housing of the resonator 3.

The ECU 242 controls the electric power, which is supplied to the electromagnetic circuit 241, based on the sensed rotational speed of the engine to control the magnetic force applied to the diaphragm 113 in a stepwise manner or a continuous manner. Due to the magnetic material contained in the diaphragm 113, the eigenfrequency of the diaphragm 113 can be rapidly changed by the magnetic force, which is applied from the electromagnetic circuit 241 to the diaphragm 113. Furthermore, the ECU 242 can rapidly change the magnetic force generated from the electromagnetic circuit 241 by controlling the electric power, which is supplied to the electromagnetic circuit 241, based on the sensed rotational speed of the engine. Therefore, the wide range of the intake air sound, which changes in response to the rotational speed of the engine, can be reduced.

In the tenth embodiment, the eigenfrequency of the diaphragm 113 is controlled by the magnetic force generated from the electromagnetic circuit 241. Thus, the eigenfrequency of the diaphragm 113 can be controlled by the electromagnetic circuit 241 in the non-mechanical way without making a contact with the diaphragm 113. Furthermore, the electromagnetic circuit 241 does not have a movable component, such as a motor. Thus, the eigenfrequency of the diaphragm 113 can be controlled in a stable manner by the electromagnetic circuit 241 for a long period of time. Thus, the lifetime of the diaphragm 113 as well as the lifetime of the electromagnetic circuit 241 can be lengthened.

Eleventh Embodiment

Figure 20:
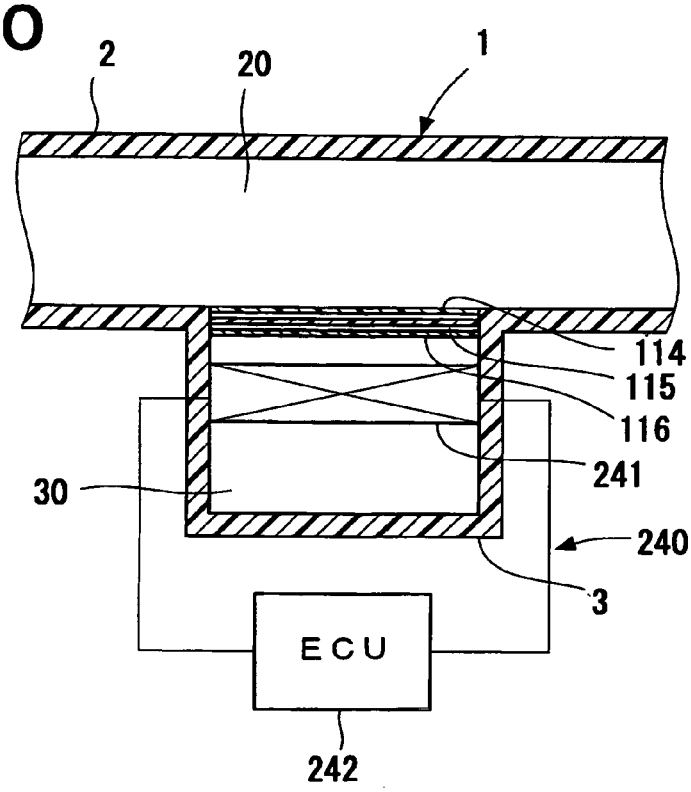
FIG. 20 is a cross sectional view of an intake muffler according to an eleventh embodiment of the present invention.

FIG. 20 shows the intake muffler 1 according to an eleventh embodiment. The intake muffler 1 of the eleventh embodiment is similar to that of the tenth embodiment except the number of the diaphragms.

In the eleventh embodiment, multiple diaphragms 114-116 are provided. Each of the diaphragms 114-116 is formed as a resiliently deformable thin film or plate that is made of the resin or the rubber, which contains the magnetic material. The diaphragms 114-116 have different eigenfrequencies, respectively because the diaphragms 114-116 have different wall thicknesses, respectively, or are made of different materials, respectively. Thus, when the magnetic force, which is applied from the electromagnetic circuit 241 to the diaphragms 114-116, changes, the eigenfrequencies of the diaphragms 114-116 change. Therefore, through the combination of the eigenfrequencies of the diaphragms 114-116, it is possible to limit the wide range of the frequencies of the intake air sound. As a result, according to the eleventh embodiment, the wide range of the intake air sound can be reduced with the relatively simple structure.

In the eleventh embodiment, the three diaphragms 114-116 are used. However, the number of the diaphragms is not limited to three and may be changed to two or more than three.

Twelfth Embodiment

Figure 21:
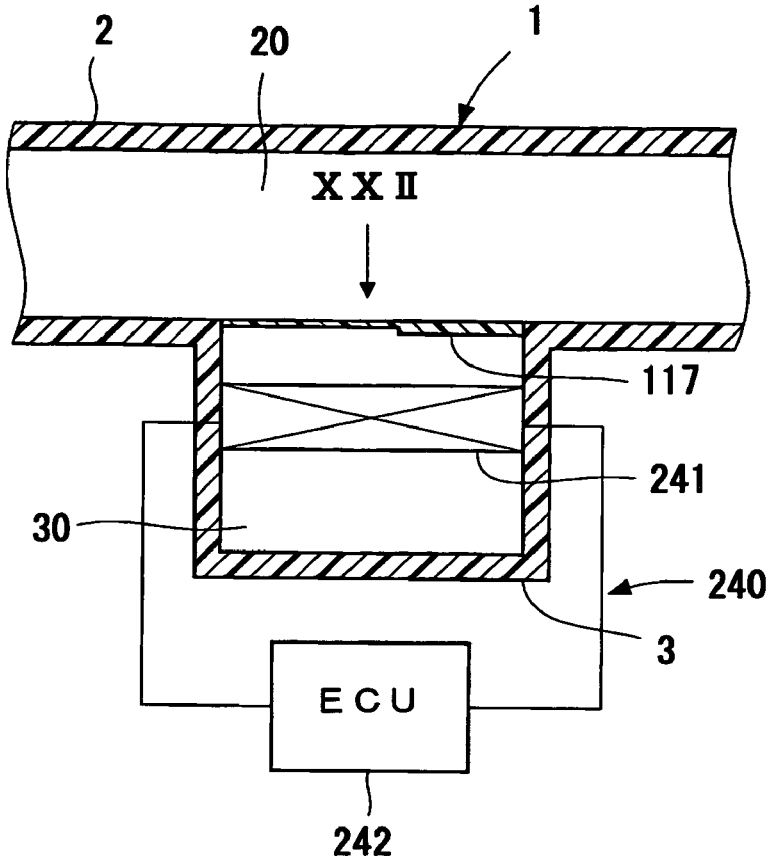
FIG. 21 is a cross sectional view of an intake muffler according to a twelfth embodiment of the present invention.
Figure 22:
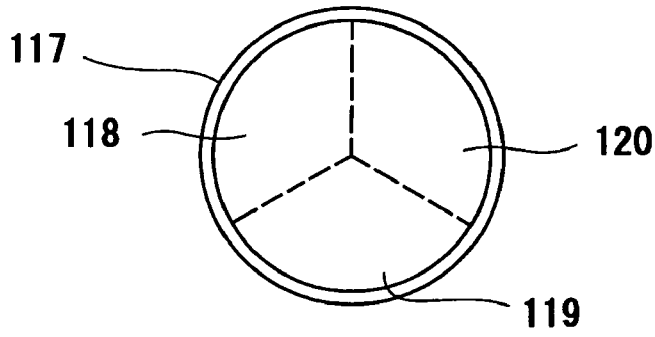
FIG. 22 is a view taken in a direction of an arrow XXII in FIG. 21.
Figure 23:
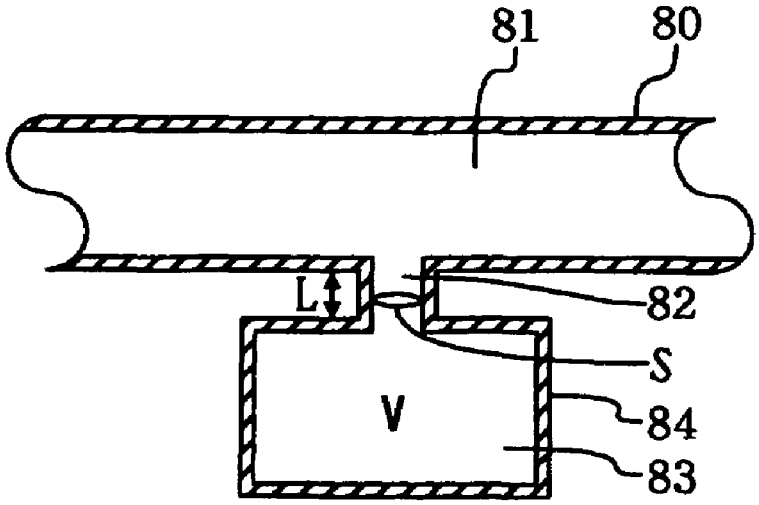
FIG. 23 PRIOR ART
FIG. 23 is a cross sectional view showing a prior art intake muffler.

FIG. 21 shows the intake muffler 1 according to a twelfth embodiment. The twelfth embodiment is implemented by applying the structure of the tenth embodiment to the first embodiment.

Specifically, in the twelfth embodiment, a diaphragm 117, which is similar to the diaphragm 4 shown in FIG. 2, includes multiple oscillation sections 118-120 that have different wall thicknesses. In this way, the advantages of first embodiment as well as the advantages of the tenth embodiment can be achieved according to the twelfth embodiment.

Although the three oscillation sections 118-120 are provided in the twelfth embodiment, the number of the oscillation sections is not limited to three and may be changed to two or more than three.

MODIFICATIONS

In the twelfth embodiment, the adjuster 240 of the tenth embodiment is applied to the first embodiment. Alternatively, the adjuster 240 of the tenth embodiment may be applied to any other embodiments. For example, the adjuster 240 of the tenth embodiment may be implemented in any one of the second to ninth embodiments, and each diaphragm of that embodiment is changed to include the magnetic material. Even in this way, advantages similar to those of the tenth embodiment can be achieved. Also, any one or more components of any one of the first to twelfth embodiments may be combined with any one or more components of another one of the first to twelfth embodiments depending on an intended use.

The shape of each diaphragm described in any one of the first to twelfth embodiments is not limited the described one and may be changed to any other appropriate shape.

Additional advantages and modifications will readily occur to those skilled in the art. The invention in its broader terms is therefore not limited to the specific details, representative apparatus, and illustrative examples shown and described.

What is claimed is:

1. An intake muffler for an internal combustion engine, comprising:

an air conductive member that forms an air passage therein to conduct intake air from an air cleaner to the engine; and a resonator that is connected with the air conductive member between the air cleaner and the engine and forms a closed resonant chamber therein, wherein:

the resonator includes at least one diaphragm, which is generally planar and is disposed between the air passage and the resonant chamber; and the at least one diaphragm forms multiple oscillation sections, which have different eigenfrequencies, respectively.

2. The intake muffler according to claim 1, wherein the at least one diaphragm includes a single diaphragm.

3. The intake muffler according to claim 2, wherein the single diaphragm is tensioned in such a manner that a tensile force, which is exerted in the single diaphragm in one direction in a plane of the single diaphragm, differs from a tensile force, which is exerted in the single diaphragm in another direction in the plane of the single diaphragm.

4. The intake muffler according to claim 1, wherein the multiple oscillation sections have different elastic moduli, respectively.

5. The intake muffler according to claim 4, wherein the multiple oscillation sections have different thicknesses, respectively.

6. The intake muffler according to claim 4, wherein the multiple oscillation sections are made of different materials, respectively.

7. The intake muffler according to claim 4, wherein the multiple oscillation sections are arranged one after another in a propagating direction of sound in the air passage.

8. The intake muffler according to claim 1, wherein the at least one diaphragm includes multiple diaphragms, which are formed separately.

9. The intake muffler according to claim 8, wherein:

the air conductive member forms a surge tank, which is placed between a throttle valve and an intake manifold of an internal combustion engine; and the resonator is placed inside the surge tank.

10. The intake muffler according to claim 9, wherein:

the resonator includes multiple partition walls, which form the resonant chamber; and one of the multiple partition walls is a wall of the surge tank.

11. The intake muffler according to claim 1, wherein nonflammable gas is filled in the resonant chamber.

12. The intake muffler according to claim 1, wherein each diaphragm is made of one of a rubber material and a resin material.

13. The intake muffler according to claim 1, wherein:

each diaphragm includes a magnetic material; and the intake muffler further comprises an adjuster that adjusts the eigenfrequency of each diaphragm by applying a magnetic force to the diaphragm.

14. The intake muffler according to claim 13, wherein the adjuster includes:

an electromagnetic circuit, which applies the magnetic force to the diaphragm; and a controller that controls the electromagnetic circuit to adjust the magnetic force generated from the electromagnetic circuit.

15. The intake muffler according to claim 14, wherein the controller controls the electromagnetic circuit based on a rotational speed of an internal combustion engine that is connected to the air conductive member.

16. An intake muffler comprising:

an air conductive member that forms an air passage therein to conduct intake air;

a resonator that is connected with the air conductive member and forms a resonant chamber therein, wherein:

the resonator includes a diaphragm, which is generally planar and is disposed between the air passage and the resonant chamber; and the diaphragm includes a magnetic material; and an adjuster that adjusts an eigenfrequency of the diaphragm by applying a magnetic force to the diaphragm.

17. The intake muffler according to claim 16, wherein the adjuster includes:

an electromagnetic circuit, which applies the magnetic force to the diaphragm; and a controller that controls the electromagnetic circuit to adjust the magnetic force generated from the electromagnetic circuit.

18. The intake muffler according to claim 17, wherein the controller controls the electromagnetic circuit based on a rotational speed of an internal combustion engine that is connected to the air conductive member.

19. The intake muffler according to claim 16, wherein the diaphragm is made of one of a rubber material and a resin material.

* * * * *